US006333725B1

(12) United States Patent
Kim

(10) Patent No.: US 6,333,725 B1
(45) Date of Patent: Dec. 25, 2001

(54) DATA INTERFACING APPARATUS OF AC TYPE PLASMA DISPLAY PANEL SYSTEM

(75) Inventor: Se-Yong Kim, Seoul (KR)

(73) Assignee: Daewoo Electronics, Co., Ltd., Seoul (KR)

( * ) Notice: Subject to any disclaimer, the term of this patent is extended or adjusted under 35 U.S.C. 154(b) by 0 days.

(21) Appl. No.: 09/241,397

(22) Filed: Feb. 2, 1999

(30) Foreign Application Priority Data

Jun. 30, 1998 (KR) ..... 98-25730
Jun. 30, 1998 (KR) ..... 98-25737

(51) Int. Cl.[7] ..... G09G 3/28
(52) U.S. Cl. ..... 345/61; 345/60; 345/72
(58) Field of Search ..... 345/60–61, 67, 345/72

(56) References Cited

U.S. PATENT DOCUMENTS 5,742,265 * 4/1998 Stoller et al. ..... 345/61
5,892,492 * 4/1999 Osawa et al. ..... 345/60

FOREIGN PATENT DOCUMENTS 0 149 831 7/1985 (EP) .
2 758 204 7/1998 (FR) .

* cited by examiner

*Primary Examiner*—Richard Hjerpe
*Assistant Examiner*—Duc Q Dinh
(74) *Attorney, Agent, or Firm*—Pillsbury Winthrop LLP

(57) ABSTRACT

A data interfacing apparatus for interfacing a frame memory with upper and lower address electrode drivers in an alternating current type plasma display panel system is disclosed. The data interfacing apparatus includes a pair of provisional storing sections for provisionally storing RGB data supplied from the frame memory and a shift signal generator for generating a clock signal to provide the clock signal to the respective provisional storing sections. Each of the provisional storing sections includes N shift registers consisting of M delayed flip-flops. Respective input terminals of the shift registers are connected to N output terminals of the frame memory one-to-one. The respective shift registers shift M times the RGB data, which is transferred to the respective input terminals by one bit from the frame memory, and provisionally latch N×M bits RGB data in response to a clock signal. The shift signal generator produces M shift signals by using a first signal which represents a start of a horizontal line and a second signal which is a system reference clock, and then produces the clock signal by using a third signal whose logical level is alternately inverted by the period of the horizontal line and the M shift signals.

2 Claims, 4 Drawing Sheets

DATA INTERFACING APPARATUS OF AC TYPE PLASMA DISPLAY PANEL SYSTEM

BACKGROUND OF THE INVENTION

1. Field of the Invention

The present invention relates to a flat panel display apparatus and, more particularly, to a data interfacing apparatus for interfacing between a frame memory and an address electrode driving means for driving address electrodes of a flat panel display system which uses a red-green-blue(RGB) strip-type plasma display panel.

2. Description of the Prior Art

Customers of television sets have demanded slim display apparatus which have wide screen. Since existing cathode ray tube (CRT) equipments have started reveal limitations in fulfilling such a demand, they are replaced by a so-called flat panel display (FPD) apparatuses that has a wide and slim display area. Further, many research projects in FPD field are globally in process.

The FPD apparatus is largely divided into an emissive device and a non-emissive device. The emissive device, usually called an active emitting device, is a device which emits a light by itself. Typical examples of the emissive devices are a field emission display (FED) device, a vacuum fluorescent display (VFD) type device, an electro-luminescence (EL) type device, a plasma display panel (PDP) and the like. The non-emissive device is called a passive light emitting device, and there are examples of the non-emissive device such as a liquid crystal display (LCD) device, an electro-chromic display (ECD), an electro-phoretic display (EPID) and the like.

Currently, the LCD device occupies a main stream of production in electric and electronis goods such as desk clocks, calculators, lap-top computers and the like. Although this device can be adopted to television sets having a screen size of more than 21 inches, it has also shown the limitations in manufacturing process of panels and in obtaining satisfiable products. Further, it has problems of having a narrow visual field angle and a response rate varies subject to a temperature change. Due to a capability of solving these problems of the LCD device, the PDP newly attracts public attention as a next generation FPD.

Since, in principle, the PDP emits a light by itself similarly to that of a fluorescent lamp, it has uniform brightness and a high contrast although a screen area of the PDP is as wide as a screen area of the CRT. In addition, the PDP has a visual field angle of more than 140 degrees and above, and is well-known as the best and widest screen display device which has a screen size of 21 to 55 inches. The panel manufacturing process of the PDP is simplified as compared with that of the LCD device and thereby saves a manufacturing cost. However, because the manufacturing cost of the PDP is more expensive than that of the CRT, manufacturers have sought to reduce the manufacturing cost.

The plasma display is largely classified as a direct current (DC) type and an alternating current (AC) type according to a structural difference of a discharge cell thereof and a form of a driving voltage based on the structural difference. The DC type is driven by a DC voltage whereas the AC type is driven by a sinusoidal AC voltage or by a pulse voltage. The AC type includes such a structure that a dielectric layer covers an electrode to be served as a current regulation resistor. On the other hand, the DC type includes such a structure that an electrode is exposed to a discharge room as it is and a discharge current comes to flow during a supply of the discharge voltage. Because the AC type has the electrode which is covered with the dielectric, it is more durable than the DC type. The AC type has a further advantage in that a wall electric charge which is generated on a surface of the dielectric as a result of a polarization causes the cell to have a memory function therein, and is more applicable than others in the field of display devices.

A color PDP includes a structure of three terminals wherein a special electrode is installed in order to improve discharge characteristics thereof. Namely, the 3-terminal structure comprises three electrodes per unit cell for a display which are an address electrode for entering data, a maintenance electrode for sequentially scanning a line and for maintaining a cell discharge, and a bus electrode for helping a discharge maintenance.

A number of the address electrode for entering data is determined in accordance with a horizontal resolution. For example, in a case where samples of the red, green and blue colors per line are 853, a total number of the samples amounts to 2559. Therefore, a required number of the address electrodes is also 2559. In a case where an arrangement of the address electrode has a strip form, red, green and blue electrodes are arranged repeatedly.

As described above, because a circuit arrangement of an electrode driving section is restricted to a consideration of a space utilization when thousands of the address electrodes are arranged on one side, an upper and lower electrode driving system is adapted wherein section for driving 1280 electrodes, which are ordered in an odd-numbered sequence, are arranged at an upper end portion of a panel whereas section for driving 1279 electrodes, which are ordered in an even-numbered sequence, are arranged at a lower end portion thereof (refer to U.S. Pat. No. 4,695,838).

Meanwhile, in order to display a TV signal of a system of national television system committee (NTSC) on the PDP, a data processing section converts an interlaced scanning system into a sequential scanning system, and also converts data into data of a subfield system for a PDP contrast-processing. Further, the data processing section provides 1280 RGB pixel data per line to the electrode driving section for driving the upper and lower address electrodes of the panel of the PDP in harmony with the arrangement of the address electrode.

Conventionally, a video data processing section of the PDP includes a data rearranging section for rearranging digital RGB sample data into subfield data for the contrast-processing, a frame memory section for converting one scanning system into the other, a data interfacing section, and a timing control section.

A composite video signal received through an antenna is processed into an analog signal by a video/audio signal processing section, and the analog signal is converted into a digital video signal by an analog-to-digital converting section. This digital video signal is transferred in turn through the data rearranging section, the frame memory section and the data interfacing section to an address electrode driving section of a data stream type which is suitable for contrast-processing of the PDP. For suitable timing-controls to respective sections, the timing controlling section generates timing control signals for respective sections by frequency-dividing a main clock signal.

The data interfacing section has roles of storing a horizontal line data sequentially outputted from the frame memory section and outputting the horizontal line data suitable for input order of the address electrode driving section. The data interfacing section needs a storing capacity of at least 5118 bits in order to simultaneously input and output the horizontal line data that amount to 2559 bits (853 bits×3) in a color PDP-TV whose one horizontal line consists of 853 pixels. Generally, the data interfacing section has two data interfacing chips in the PDP-TV with dual address electrodes, each of upper and lower data interfacing chips needs of a storing capacity at least 2559 bits.

There has been a prior PDP-TV system using a delayed flip-flop as a storing logic of the data interfacing chip. In the prior PDP-TV system, the data interfacing chip has to includes 2592 delayed flip-flops, which are usually designed as a matrix structure of 48 rows by 54 columns, to store the horizontal line data (2559 bits). Since 48 (bits)×54 (times) output data from the frame memory section have to be separately transferred to respective 2592 delayed flip-flops, a pattern of connection paths between the frame memory section and the respective 2592 delayed flip-flops becomes very complex. It is hard to design a data interfacing chip which has such a logic. Furthermore, many control signals are necessary for controlling the 2592 delayed flip-flops and such a data interfacing chip is not flexible for increasing a storing capacity.

On the other hand, the data interfacing chip includes two provisional storing logics and each provisional storing logic consists of 2559 delayed flip-flops. This configuration of the data interfacing chip purposes for a continuity of a data flow in input and output operations by simultaneously performing receipt of a current horizontal line data from the frame memory and outputting the previously received horizontal line data. A logic for selecting one between the two provisional storing logics to store the data transferred from the frame memory is necessary, and a demultiplexer has been used for the logic. For example, when an amount of output data transferred every time from the frame memory is 48 bits, an input pin number of the demultiplexer should be 48 and every output pin of the demultiplexer should be connected to 5184 delayed flip-flops which consist of the two provisional storing logics. Besides, an additional logic for controlling input and output operations of the demultiplexer is necessary. Accordingly, connection paths between the frame memory and the two provisional storing logics of the data interfacing chip become very complicated and it is hard to design the data interfacing chip with such complicated connection paths.

SUMMARY OF THE INVENTION

Therefore, in order to settle the problems of the prior art as described above, it is a first object of the present invention to provide a data interfacing chip which can be easily designed due to an input line number of the provisional storing logic reduced by making the provisional storing logics of multiple shift registers.

It is another object of the present invention to provide a data interfacing chip whose input logic is simplified by directly connecting the frame memory to the provisional storing logic of the data interfacing chip without using a demultiplexer and by controlling a data transfer operation from the frame memory to the data interfacing chip.

In order to achieve the first object, the present invention provides a data interfacing apparatus for interfacing a frame memory means with upper and lower address electrode driving means in an alternating current type plasma display panel system, comprising:

a provisional storing means for repeatedly receiving M times by N bits red-green-blue (RGB) data from the frame memory means to provisionally store a horizontal line RGB data in response to a shift control signal, wherein a transfer order of the horizontal line RGB data from the frame memory means is suitable for a pixel arrangement of a plasma display panel; and a shift signal generating means for generating the shift control signal and for providing the shift control signal to the provisional storing means, wherein the provisional storing means includes one or more provisional storing sections, the provisional string section includes N number of shift registers, where a capacity of one shift register is M bits, respective input terminals of the N number of shift registers are respectively connected to N number of output terminals of the frame memory means, and respective the N number of shift registers provisionally store N×M bits RGB data by shifting M times the N bits RGB data per one time transferred from the frame memory means through the respective input terminals in response to the shift control signal.

The provisional storing means comprises first and second provisional storing sections and the first and second provisional storing sections alternately receive the horizontal RGB data from the frame memory means.

The shift signal generating means comprises: a M bits shift register means for generating M number of shift signals, wherein the M bits shift register means includes M number of delayed flip-flops which are serially connected, a front delayed flip-flop of the M number of delayed flip-flops receives a first signal which represents a front of every horizontal line, and respective delayed flip-flops receive a second signal which is a system reference signal and generate the M number of shift signals; an inverting means for inverting a logical level of a third signal whose logical level is alternately inverted by the horizontal line; a first logic means for providing the shift control signal obtained by logically multiplying the third signal by the M number of shift signals to the first provisional storing section; and a second logic means for providing the shift control signal obtained by logically multiplying an output signal from the inverting means by the M number of shift signals to the second provisional storing section.

BRIEF DESCRIPTION OF THE DRAWINGS

The above objects and other advantages of the present invention will become more apparent by describing in detail preferred embodiments thereof with reference to the attached drawings, in which.

DESCRIPTION OF THE PREFERRED EMBODIMENTS

Figure 1:
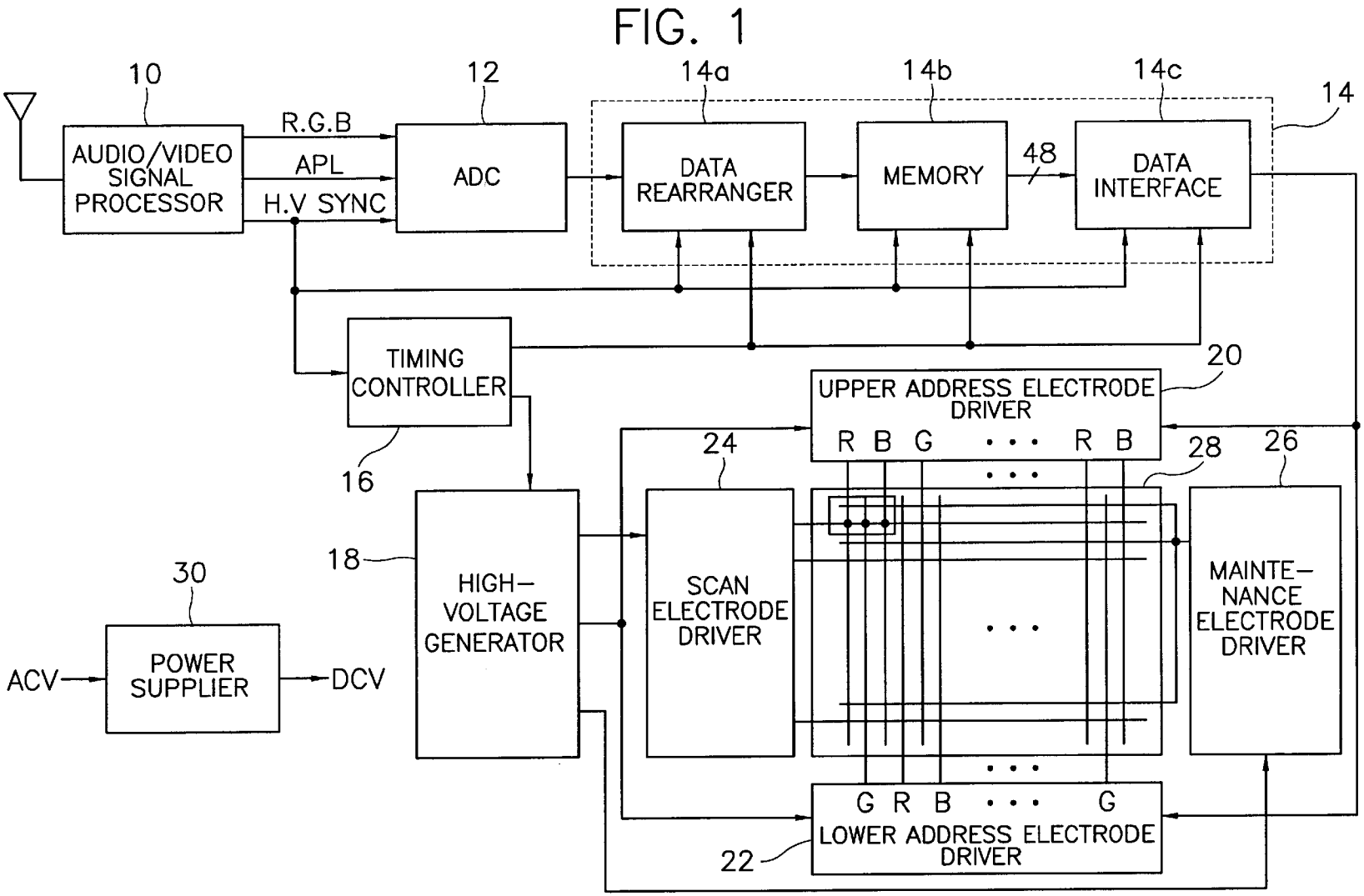
FIG. 1 is a block diagram showing a circuit configuration of a PDP television set.

Hereinafter, a preferred embodiment of the present invention will be explained in more detail with reference to the accompanying drawings. Referring to FIG. 1, a PDP-TV includes a video processing section for converting an NTSC composite video signal into a signal form which is adapted to the PDP-TV system and a driving circuit section for displaying processed video data through a panel thereof.

Broadly speaking, a composite video signal which is received through an antenna is analog-processed by an audio/video (A/V) signal processing section 10, and an analog-processed signal is then digitized to a prescribed video data by an analog-to-digital converter (ADC) 12. Afterwards, while passing through a data rearranging section 14*a*, a frame memory section 14*b* and a data interfacing section 14*c* of a data processing section 14, the video data are converted into a data stream which is adapted to a contrast-processing characteristic of the PDP, and then a converted data stream is then provided to upper and lower address electrode driving sections 20 and 22.

Under the control of a timing controller 16, a high-voltage generating section 18 provides a high-voltage control pulse which is required by upper address electrode driving section 20, lower address electrode driving section 22, a scan electrode driving section 24 and a maintenance electrode driving section 26, and a power supplying section 30 inputs an AC voltage to produce all DC voltages which are required by a whole system.

A/V signal processing section 10 inputs the NTSC composite video signal to separate an analog RGB and a horizontal or vertical synchronizing signal (H,V SYNC), and produces an average picture level (APL) which corresponds to an average value of a luminance signal to ADC 12 and which is then provided to ADC 12.

The interlaced scanning system is adopted for the NTSC composite video signal whose one frame consists of two fields of even- and odd-numbered sequences, and whose horizontal and vertical synchronizing signals have frequencies of 15.73 [KHz] and 60 [Hz], respectively. An audio signal which is separated from the composite video signal is directly provided to a speaker via an audio amplifier.

ADC 12 inputs the analog RGB signal to convert the inputted analog RGB signal into digital data, and provides the converted digital data to data processing section 14. Here, the digital data is video data whose signal form is converted for improving brightness of the PDP-TV system. ADC 12 amplifies the analog RGB signal and the APL signal for having signal levels thereof which are adapted to quantization, and converts the vertical and horizontal synchronizing signals for having prescribed phases thereof. Also, ADC 12 generates a clock by using a phase-locked loop (referred to as "PLL") in order to use a sampling clock as a synchronized clock with an input synchronizing signal.

The PLL compares a phase of a variable pulse from a loop with a phase of an input synchronizing signal, and provides a synchronized clock with the input synchronizing signal. In a case where the clock which is not synchronized with the input synchronizing signal is used, a vertical linearity of a picture to be displayed is not ensured.

Also, ADC 12 sets vertical and horizontal positions of a sampling area. In a vertical position section, only lines which include the video signal among the input signals are set. In a horizontal position section, only time which includes the video signal among the lines which is set to the vertical position is set. Both the vertical position section and the horizontal position section are a reference for a sampling. As illustrated in Table 1, a total of 480 lines is selected in 240 lines of units for the vertical position section. The horizontal position section has to correspond to a time interval in which at least 853 sampling clocks can exists per line.

Also, ADC 12 maps the RGB data to data which coincides with a brightness characteristic of the PDP and outputs a mapped RGB data. That is, ADC 12 includes a read only memory (ROM) which has a plurality of vector tables recorded therein, and then maps an optimal vector table read from ROM 1 to 1 in accordance with a digitized APL data in order to provide an improved form of RGB data to data processing section 14.

TABLE 1

| | 1 frame | | |
|---|---|---|---|
| items | odd | even | remarks |
| total lines | 1H–262.5H | 262.5H–525H | NTSC TV |
| active lines | 22H–263H | 284H–525H | |
| selective lines | 23H–262H | 285H–524H | |

In order to process the contrast of the PDP, data rearranging section 14*a* of data processing section 14 is required to reconfigure the video data into a plurality of subfields, and then to rearrange data bits from the most significant bit (MSB) to the least significant bit (LSB). Data rearranging section 14*a* performs rearrangement so that the video data provided in parallel may be stored at a location specified by an address of the frame memory 14*b* as bits having the same weight.

Here, in order to distinguish data for the upper address electrode from data for the lower address electrode, there is configured one word in which among respective 8 1-bit data with respect to rearranged red and blue, 4 1-bit data in an odd-numbered sequence are placed at an upper bit while 4 1-bit data in an even-numbered sequence are placed at a lower bit, and in which among 8 1-bit data with respect to a rearranged green, four one-bit data in an odd-numbered sequence are placed at a lower bit while 4 1-bit data in an even-numbered sequence are placed at an upper bit.

Because frame memory section 14*b* of data processing section 14 divides one field into eight subfields for the contrast-processing of the PDP, and reads in series the video data corresponding to the respective subfields in harmony with an arrangement order of the electrodes to provide the read video data to data interfacing section 14*c*, reading order is quite different from writing order from a structure aspect.

Data interfacing section 14*c* rearranges the RGB data from frame memory section 14*b* in harmony with an arrangement of an RGB pixel of a display section 28 and provides the rearranged RGB data to an address driving integrated circuit (IC). Data interfacing section 14*c* provisionally stores the RGB data from frame memory section 14*b* and then provides read RGB data respectively to upper and lower address electrode driving sections 20 and 22 in a data form which is required by upper and lower address electrode driving sections 20 and 22.

High-voltage generating section 18 combines the DC high-voltages in accordance with a control pulse having various logic levels from timing controller 16, and produces the high-voltage control pulse which is required by upper address electrode driving section 20, by lower address electrode driving section 22, by scan electrode driving section 24 and by maintenance electrode driving section 26, and which enables the PDP to be driven. Upper and lower address electrode driving sections 20 and 22 adequately raise a voltage level of the data from data interfacing section 14*c*, and a selective entry can be executed into display section 28.

A driving method for the contrast-processing of the PDP according to the present invention, divides one field into a plurality of subfields, i.e., 256 contrast—8 subfields, and enters the video data corresponding to respective subfields by the line into display section 28 via upper and lower address electrode driving sections 20 and 22. The method sets a number of discharge maintenance pulses to a smaller one in an order starting from a subfield having MSB data entered therein to the subfield having LSB data entered therein, and performs the contrast-processing on the basis of a total discharge maintenance period according to a combination therebetween.

Upper and lower address electrode driving sections 20 and 22 include 20 driving ICs which have both 4-bit input pins and 64-bit output pins. Thus, respective driving sections load the data corresponding to one line alternately in an even or odd order over 32 times in total in 40 units from data interfacing section 14*c*, and then drives one line of electrodes simultaneously.

The same data is displayed twice in even and odd fields and thereby eliminates a flickering which accompanies a non-interlacing scan. A driving order of the divided subfields is described as follows.

1) Entry and elimination of a whole screen

In order to eliminate a wall electric charge which remains at a selected pixel after a discharge maintenance of a previous subfield, the wall electric charge is entered a whole pixel for a short time which is not enough to be visible, and the whole pixels are then eliminated to remove all of the remaining wall electric charges and to initialize the whole pixels.

2) Entry of data

While shifting a scan pulse in sequence at a scan electrode, a relevant data is entered by the line through an address electrode, and thereby forming the wall electric charge at a pixel which is intended to be discharged.

3) Maintenance of a discharge

The discharge of a pixel having the wall electric charge which is formed therein while alternately applying the maintenance pulse between the maintenance electrode and the scan electrode is initiated and is then maintained. At this time, because there is such a possibility that a peripheral pixel, which is entered, influences another pixel, which is not entered, to produce an erroneous discharge, elimination of a narrow range is performed every time after applying the maintenance pulse, and a correct discharge is then performed. A time for maintenance of a discharge can vary according to weight of respective subfields.

Figure 2:
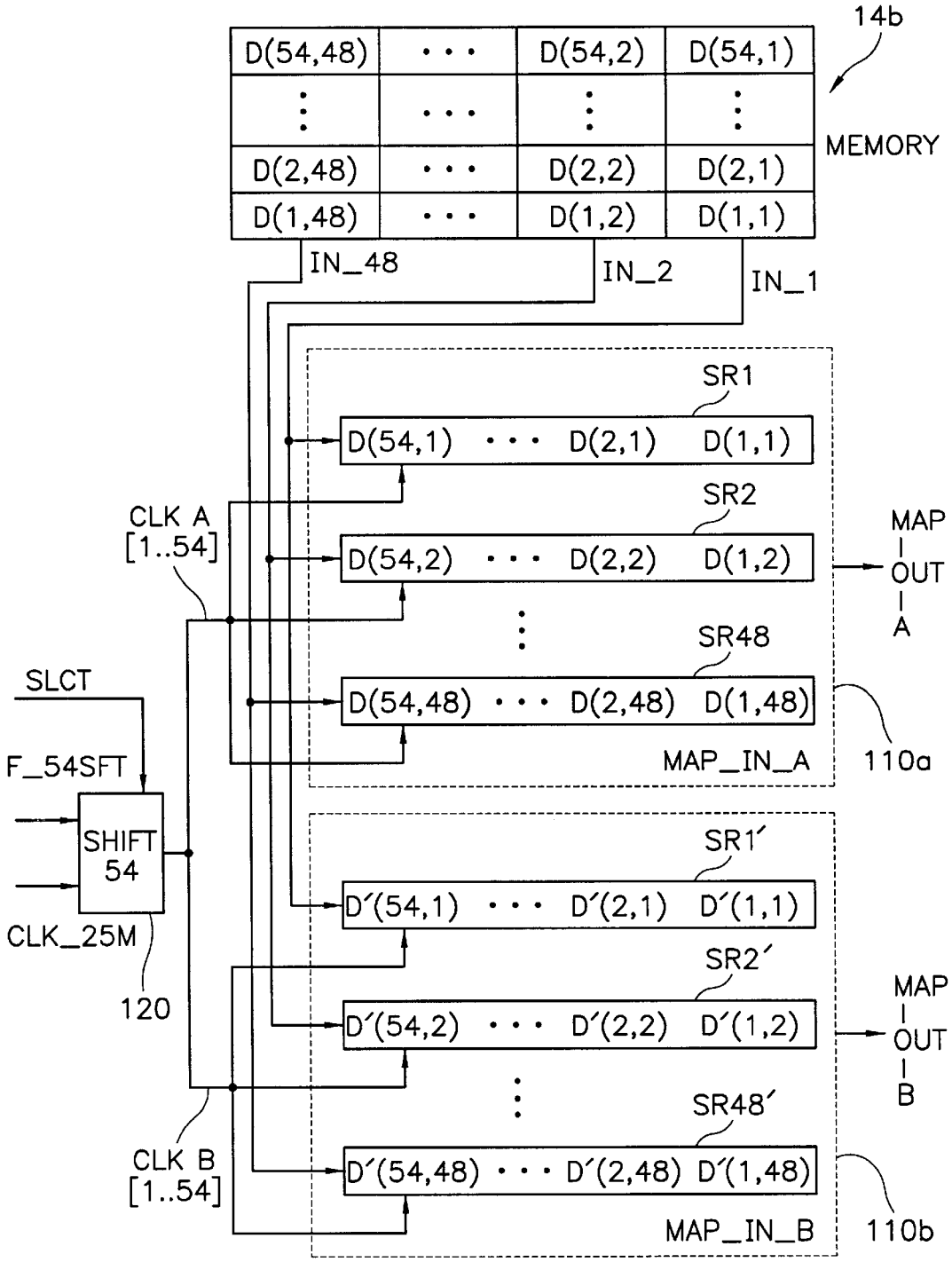
FIG. 2 shows a configuration of a data inputting section of a data interfacing chip according to an embodiment of the present invention.

A data interfacing section 14*c* according to an embodiment of the present invention has a data input section which has a configuration shown in FIG. 2. Data interfacing section 14*c* receives M times a horizontal line RGB data from frame memory 14*b* by N bits, where N×M bits of the horizontal line RGB data are rearranged to be suitable for a pixel arrangement of plasma panel 28, and transfers the horizontal line RGB data to upper and lower address electrode driving sections 20 and 22. Here, a case that numerical values of the N and M are 48 and 54, respectively, is premised. The data input section plays roles of provisionally storing the RGB data transferred from frame memory 14*b* and then transferring the RGB data to upper and lower address electrode driving sections 20 and 22 through data output sections (MAP_OUT_A & MAP_OUT_B: not shown).

The data input section of data interfacing section 14*c* includes a pair of provisional storing sections 110*a* and 110*b* which have an identical logic with each other and a shift signal generating section 120. First provisional storing section 110*a* includes 48 shift registers SR1, SR2, . . . , SR48, where respective shift registers are 54 bits in size. Respective input terminals of shift registers SR1, SR2, . . . , SR48 are connected to 48 output terminals of frame memory 14*b* one-to-one and output terminals of shift registers SR1, SR2, . . . , SR48 are connected to first data output section MAP_OUT_A. Respective shift registers SR1, SR2, . . . , SR48 receive a first shift signal CLKA[1 . . . 54] which is 54 bits signal from shift signal generating section 120. Second provisional storing section 110*b* also includes 48 shift registers SR1', SR2', . . . , SR48', where respective shift registers are 54 bits in size. Respective input terminals of shift registers SR1', SR2', . . . , SR48' are also connected to 48 output terminals of frame memory 14*b* one-to-one and output terminals of shift registers SR1', SR2', . . . , SR48' are connected to second data output section MAP_OUT_B. Respective shift registers SR1', SR2', . . . , SR48' receive a second shift signal CLKB[1 . . . 54] which is 54 bits signal from shift signal generating section 120.

In prior art, since each of first and second provisional storing sections 110*a* and 110*b* uses 2592 (48×54) delayed flip-flops to store 2559 bits of one horizontal line RGB data, each of first and second provisional storing sections 110*a* and 110*b* should have at least 2592 input lines. However, according to the embodiment of the present invention, the 2592 delayed flip-flops are replaced by 48 shift registers of 54 bits in size, and thus only 48 input lines, which are 1/54 times as small as 2592, are sufficient.

Figure 3:
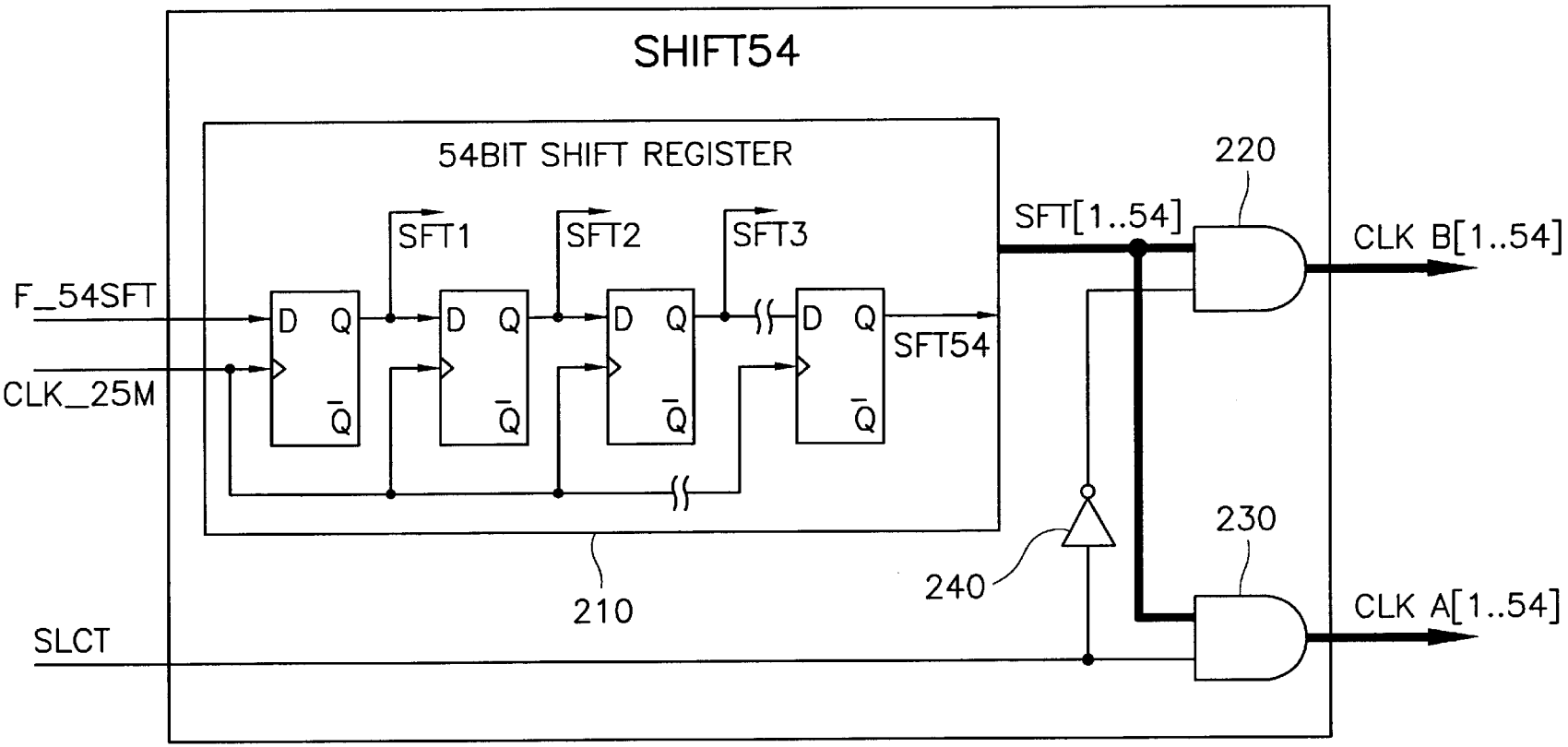
FIG. 3 shows a configuration of a shifter signal generator shown in FIG. 2.

Shift signal generating section 120, as shown in FIG. 3, includes a 54 bits shift register 210, AND gates 220 and 230, and an inverter 240. 54 bits shift register 210 includes 54 delayed flip-flops which are serially connected. A first signal F_54SFT which represents a start of the horizontal line is inputted to a terminal D of a front delayed flip-flop, and a second signal which is a system reference clock is inputted to respective clock terminals of the 54 delayed flip-flops. First signal F_54SFT is sequentially shifted to the last delayed flip-flop through terminals D and Q of respective delayed flip-flops by clocking operation of second signal CLK_25M. Accordingly, 54 bits shift signal SFT[1 . . . 54]] can be obtained from terminal Q of all the delayed flip-flops.

Inverter 240 inverts a logical level of a third signal SLCT whose logical level is alternately changed by the horizontal line period. First AND gate 230 logically multiplies third signal SLCT by 54 bits shift signal SFT[1 . . . 54] to produce a first shift signal CLKA[1 . . . 54]. Second AND gate 220 logically multiplies the output signal of inverter 240 by 54 bits shift signal SFT[1 . . . 54] to produce a second shift signal CLKB[1 . . . 54]. Namely, when a logic level of third signal SLCT is high, output signal SFT[1 . . . 54] of shift register 210 is transferred as first shift signal CLKA[1 . . . 54] through first AND gate 230 and an output logic level of second AND gate 220 is always low. On the contrary, when the logic level of third signal SLCT is low, output signal SFT[1 . . . 54] of shift register 210 is transferred as second shift signal CLKB[1 . . . 54] through second AND gate 230 and an output logic level of first AND gate 230 is always low.

Meanwhile, in prior art, in order to alternately store the RGB data supplied from frame memory 14*b* in two provisional storing sections, where each provisional storing section is configured with 48×54 delayed flip-flops, a demultiplexer (not shown) as a switching device is inserted between frame memory 14*b* and the two provisional storing sections. Accordingly, a connection pattern between the demultiplexer and the two provisional storing sections becomes complicated. However, in the embodiment of the present invention, since first and second shift signals CLKA[1 . . . 54] and CLKB[1 . . . 54] replace a function of the demultiplexer, the connection pattern is very simplified.

Figure 4:
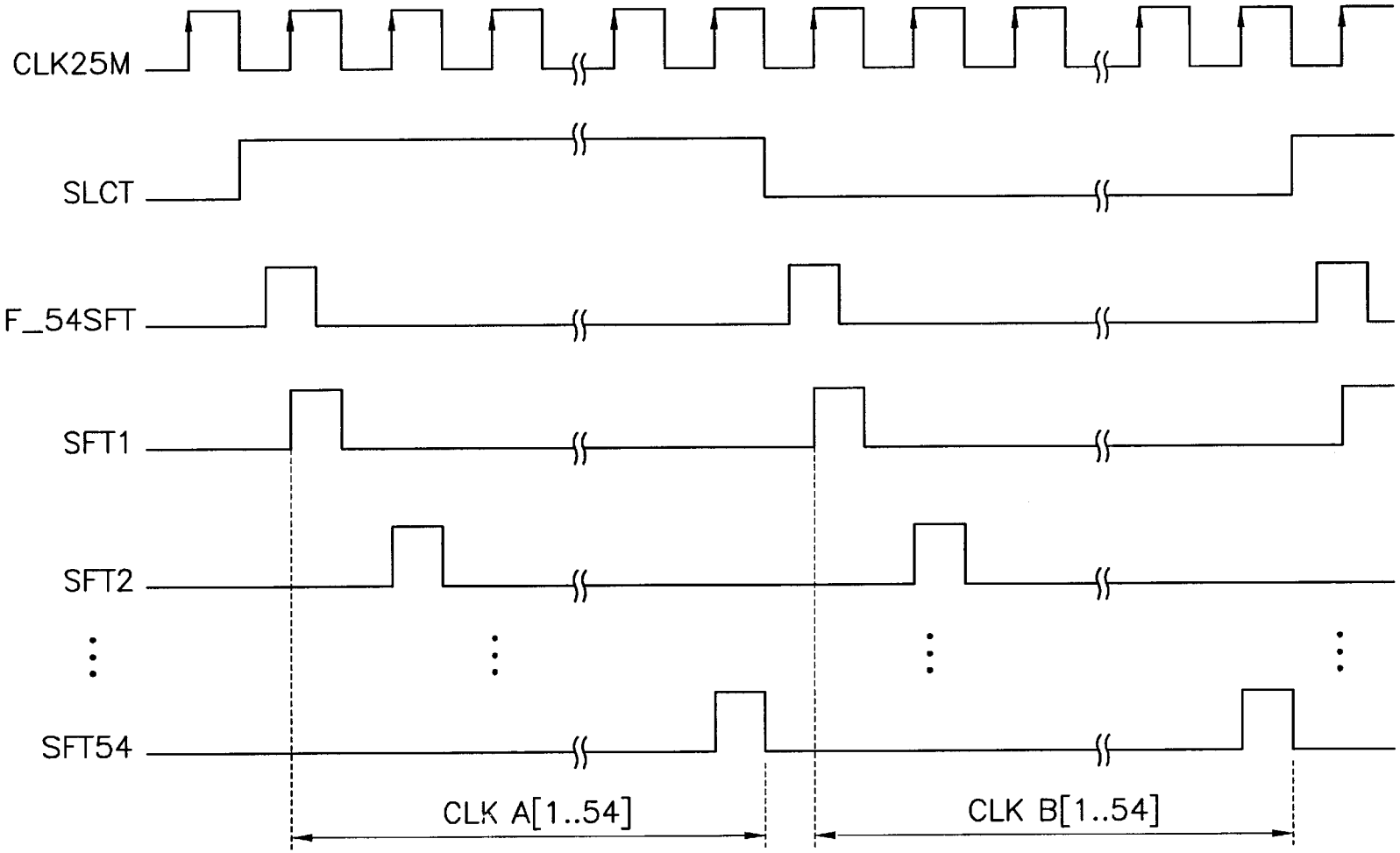
FIG. 4 is a timing chart of input/output data and control signals of the data interfacing chip shown in FIG. 2.

Referring to FIG. 4 which shows a timing chart of signals relating to data interfacing section 14*c*, an explanation about operations of data interfacing section 14*c* is given. With being controlled by every timing pulse of first and second shift signal CLKA[1 . . . 54] and CLKB[1 . . . 54] supplied from shift signal generating section 120, first and second provisional storing sections 110*a* and 110*b* store the RGB data supplied from frame memory 14*b*. Shift registers SR1, SR2, . . . , SR48 of first provisional storing section 110*a* receive first shift signal CLKA[1 . . . 54] through respective clock terminals and receive the RGB data from frame memory 14*b* through respective input terminals. Respective shift registers SR1, SR2, . . . , SR48 shift the RGB data inputted through respective input terminals by one bit at every rising edge of first shift signal CLKA[1 . . . 54]. Consequently, after $54^{th}$ rising edge of first shift signal CLKA[1 . . . 54], a first shift register SR1 latches 54 bits RGB data D(1,1), D(2,1), . . . , D(54,1) and a second shift register SR2 latches 54 bits RGB data D(1,2), D(2,2), . . . , D(54,2). In the same way, the last $48^{th}$ shift register SR48 latches 54 bits RGB data D(1,48), D(2,48), . . . , D(54,48).

The RGB data is latched in shift registers SR1', SR2', . . . , SR48' of second provisional storing section 110*b* in the same way as shift registers SR1, SR2, . . . , SR48 of first provisional storing section 110*a*. However, when first provisional storing section 110*a* receives the RGB data, second provisional storing section 110*b* simultaneously provides the latched RGB data to address electrode driving sections 20 and 22 through second data output section MAP_OUT_B. On the contrary, when second provisional storing section 110*b* receives the RGB data, first provisional storing section 110*a* simultaneously provides the latched RGB data to address electrode driving sections 20 and 22 through first data output section MAP_OUT_A. The reason is that output signal SFT[1 . . . 54] of 54 bits shift register 210 is alternately transferred as first shift signal CLKA[1 . . . 54] and second shift signal CLKB[1 . . . 54].

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A data interfacing apparatus for interfacing RGB data of a frame memory means to each of an upper address electrode driving means for driving odd-numbered electrodes in a direction of row of an AC type PDP system and a lower address electrode driving means for driving even-numbered electrodes in the direction of row of the AC type PDP system, comprising:

a first provisional storing means including N number of M-bits shift registers, input terminals of which are connected to output terminals of the frame memory by N number of lines one-to-one;

a second provisional storing means including N number of M-bits shift registers, input terminals of which are connected to the output terminals of the frame memory by the N number of lines one-to-one; and a shift signal generating means including a first means for generating M number of shift signals by using a first signal indicating a start of every horizontal line and a second signal which is a system reference clock; and a second means for alternately providing M number of shift clocks through first and second output terminals thereof to the first and second provisional storing means by using a third signal whose logical level is alternately inverted by the horizontal line and the M number of shift clocks, wherein in response to the M number of shift clocks, each of the first and second provisional storing sections receives in parallel N-bits RGB data from the frame memory M times are every horizontal line period while shifting the received N-bits RGB data in respective M-bits shift register.

2. The data interfacing apparatus as claimed in claim 1, wherein the first means includes M number of delayed flip-flops which are serially connected, a front delayed flip-flop of the M number of delayed flip-flops receives the first signal, and respective delayed flip-flops receive the second signal and generate the M number of shift signals; and the second means includes an inverter for inverting a logical level of the third signal, a first logic for providing first M number of shift clocks obtained by logically multiplying the third signal by a sequence of the M number of shift signals to the first provisional storing section; and a second logic for providing second M number of shift clocks obtained by logically multiplying an output signal from the inverter by the sequence of the M number of shift signals to the second provisional storing section.

* * * * *